US009464339B2

(12) United States Patent
de Araujo et al.

(10) Patent No.: US 9,464,339 B2
(45) Date of Patent: Oct. 11, 2016

(54) PROCESS FOR INHIBITING PARTICULATE EMISSION DURING FRICTION OF HEAT-TREATED IRON ORE PELLETS AND USE OF AN ALCOHOL BY-PRODUCT TO INHIBIT PARTICULATE EMISSION

(75) Inventors: Rodrigo Ribeiro de Araujo, Vila Velha (BR); Celso de Jesus Silva, Vitoria (BR); Antonio Alves e Silva Reis, Vitoria (BR); Leonidio Stegmiller, Vitoria (BR); Aldo Gamberini Junior, Vitoria (BR); Reinaldo Walmir de Jesus, Vila Velha (BR); Alexandre Soares Pinto, Cariacica (BR)

(73) Assignee: Vale S.A., Rio de Janeiro (BR)

( * ) Notice: Subject to any disclaimer, the term of this patent is extended or adjusted under 35 U.S.C. 154(b) by 127 days.

(21) Appl. No.: 13/265,296

(22) PCT Filed: Apr. 20, 2010

(86) PCT No.: PCT/BR2010/000135

§ 371 (c)(1),
(2), (4) Date: Apr. 4, 2012

(87) PCT Pub. No.: WO2010/121338

PCT Pub. Date: Oct. 28, 2010

(65) Prior Publication Data

US 2012/0272787 A1 Nov. 1, 2012

(30) Foreign Application Priority Data

Apr. 20, 2009 (BR) ..... 0903986

(51) Int. Cl.
*C22B 1/26* (2006.01)
*C22B 1/24* (2006.01)
*C22B 1/244* (2006.01)

(52) U.S. Cl.
CPC ..... *C22B 1/2406* (2013.01); *C22B 1/244* (2013.01); *C22B 1/2413* (2013.01)

(58) Field of Classification Search
CPC ..... C22B 1/14; C22B 1/2406; C22B 1/244; C22B 1/00; C09K 3/22
USPC ..... 75/330, 770
See application file for complete search history.

(56) References Cited

U.S. PATENT DOCUMENTS

| | | | | |
|---|---|---|---|---|
| 8,714,105 | B2 * | 5/2014 | Reis et al. | 118/667 |
| 2006/0284137 | A1 * | 12/2006 | Tran et al. | 252/70 |
| 2008/0028890 | A1 * | 2/2008 | Hey et al. | 75/770 |
| 2009/0127499 | A1 * | 5/2009 | Tran et al. | 252/70 |
| 2012/0247733 | A1 * | 10/2012 | Reis et al. | 165/104.19 |

FOREIGN PATENT DOCUMENTS

| | | | |
|---|---|---|---|
| CN | 101358115 | A | 2/2009 |
| WO | WO 2004099452 | A1 * | 11/2004 |
| WO | WO 2006/010721 | A2 | 2/2006 |

OTHER PUBLICATIONS

Crofcheck, Biodiesel Basics, Cooperative Extension Service, University of Kentucky, Apr. 2006.*

* cited by examiner

*Primary Examiner* — Jie Yang
*Assistant Examiner* — Xiaowei Su
(74) *Attorney, Agent, or Firm* — Arent Fox LLP

(57) ABSTRACT

A process for the inhibition of particulate emission during friction of heat-treated iron ore pellets includes the following steps: a) removal of heat-treated iron ore pellets at a temperature of 200° C.; and b) spraying of an alcohol by-product on pellets. The use of an alcohol by-product as an inhibitor of particulate emission is further described, with the alcohol by-product being sprayed on heat-treated iron ore pellets, which can partially or completely replace water during the handling, stacking, loading, and unloading of materials such as pellets, granules, fines, and other products from iron ore and other minerals. This process significantly reduces the emission of particulates in the an operational area.

9 Claims, 2 Drawing Sheets

PROCESS FOR INHIBITING PARTICULATE EMISSION DURING FRICTION OF HEAT-TREATED IRON ORE PELLETS AND USE OF AN ALCOHOL BY-PRODUCT TO INHIBIT PARTICULATE EMISSION

CROSS REFERENCED TO RELATED APPLICATION

This application is a National Stage entry of International Application No. PCT/BR2010/000135, filed Apr. 20, 2010, which claims priority to Brazilian Patent Application No. PI 0903986-4 filed Apr. 20, 2009, the disclosure of the prior applications being incorporated in their entirety by reference.

The present invention refers to a process of inhibiting particulate emissions during the friction of heat-treated iron ore pellets and the use of an alcohol by-product, such as glycerin, applied to materials that emit particulates when they are handled, stacked, loaded and unloaded, such as pellets, granules, fines, and other products derived from iron ore and other minerals.

DESCRIPTION OF THE STATE OF THE ART

The iron ore mining industry is of great importance to the Brazilian economy. The value representing its production is somewhere around 20% of the total Brazilian mineral production, with a significant portion of the iron ore production being destined for the foreign market.

As is known by skilled persons in the art, the iron ores commercialized for export are products in their natural form (granules, sinter feed, and pellet-feed) and in compressed form, i.e., an ore cluster or pellet. In the second case, conventionally, prior to being packed in the compartments of a ship or any other form of transport, these pellets undergo heat treatment in the plants' ovens and then are subjected to handling, stacking, and shipping.

Although this technique is regularly employed, there are a number of drawbacks generated by the production process, among them being the formation of large quantities of ore fine particles.

Studies conducted on the emission of ore particulate show that the pellets movement is the most critical moment of the production process because during their transfer from the plants to the stockyards and from there to shipping, there is constant friction between their surfaces that winds up producing fine particles, which are then released into the environment.

These particles, in powdered form, end up being blown off by the wind to the perimeters of the port facilities.

Consequently, the villages surrounding the plants and ports in the cities where mining and iron ore pelletizing play a vital economic role suffer the most from the heavy emission of particulates into the atmosphere because, in addition to being harmful to health, they are a common nuisance in daily life by dirtying roofs, walls, sidewalks and other environments, and causing eye irritation.

Likewise, the company generating this type of pollution, by not meeting the requirements of environmental standards, is subject to fines and lawsuits by governmental agencies, in addition to having their image tarnished in the eyes of society in general.

The use of water as a universal inhibitor of particulate emission is known by the state of the art; however, it isn't very efficient because the water evaporates while the pellets are still very hot and raises the final moisture content of pellets if they are cold. In addition to water being used as a dust suppression agent, there are other products on the market for this purpose, the most common of which being polymers or a paraffin base.

OBJECTIVES OF THE INVENTION

The purpose of the present invention is to promote the use of an efficient particulate emission inhibitor for application on pellets, granules, fines, and other products originating from iron ore and other minerals that will drastically reduce particulate emission, with an enduring effect, even though these products are moved, stacked, loaded and unloaded.

Another objective of this invention is to provide a process for inhibiting particulate emission caused by the friction of iron ore pellets by spraying an alcohol by-product.

BRIEF DESCRIPTION OF THE INVENTION

The invention consists of a process of inhibiting particulate emission during friction of heat-treated iron ore pellets comprising the following steps:

a) removal of heat-treated iron ore pellets at a temperature around 200° C.; and b) spraying an alcohol by-product on heat-treated pellets.

The present invention also involves the use of an alcohol by-product to inhibit particulate emission, said by-product being sprayed on iron ore pellets, whether heated or not.

BRIEF DESCRIPTION OF THE DRAWINGS

The present invention will hereinafter be more fully described on the basis of an example of execution shown in the drawings. The figures show.

DETAILED DESCRIPTION OF THE FIGURES

Figure 1:
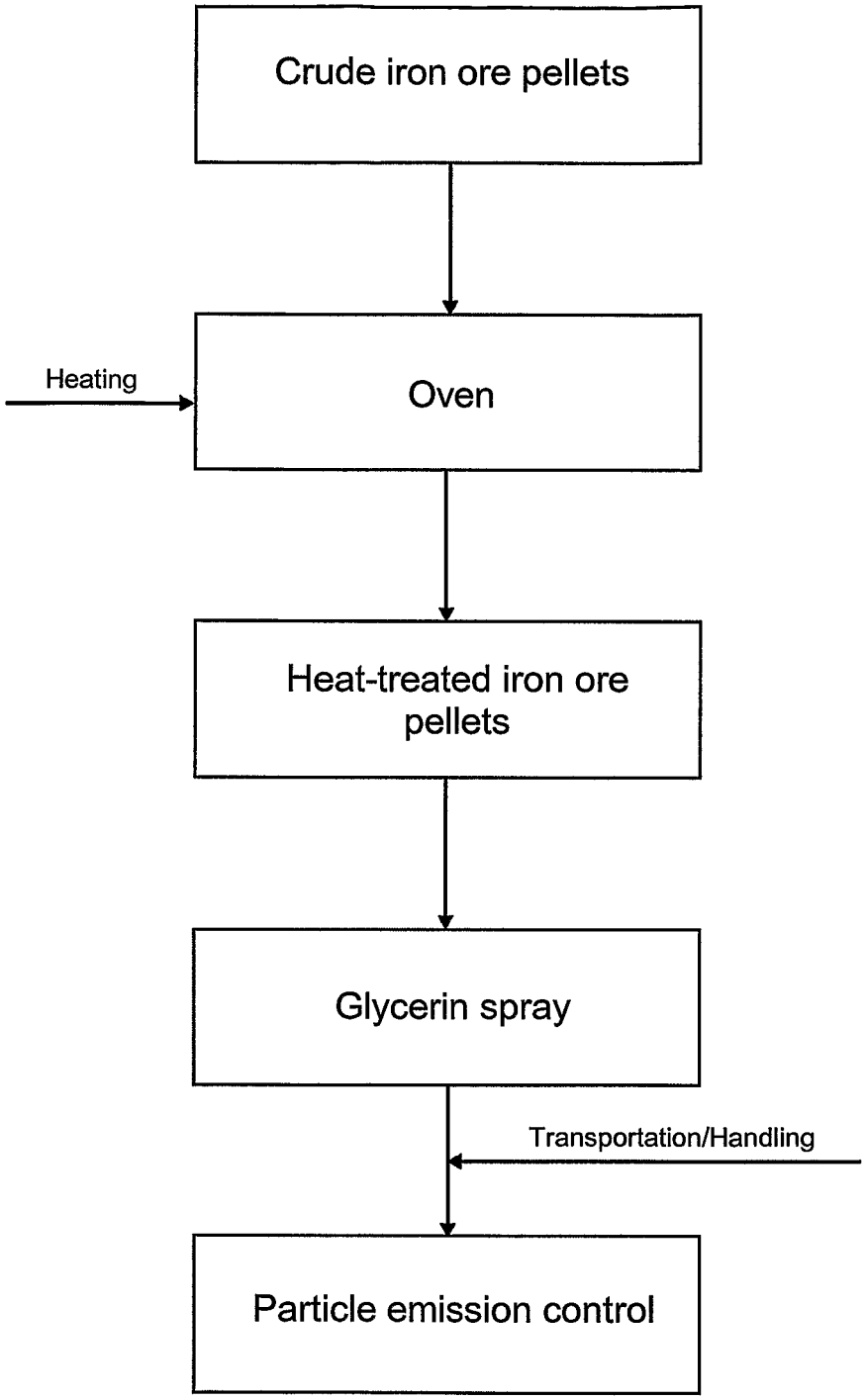
FIG. 1—presents a flowchart of the particulate emission inhibition process.

In a preferred embodiment, which can be seen in FIG. 1, the present invention is a process for inhibiting particulate emission during friction of heat-treated iron ore pellets. This process is based on the use of a high boiling point particulate emission inhibitor that does not evaporate when in contact with hot bodies, such as pellets originating from the firing process in a pelletizing plant.

This particulate emission inhibition process while furnace heat-treated iron ore pellets are subject to friction consists of the following steps:

a) removing the heat-treated iron ore pellets at a temperature around 200° C.; and b) spraying an alcohol by-product on the pellets.

Initially, crude iron ore pellets are placed in the oven to be heat-treated or fired. The maximum firing temperature is around 1,350° C., then cooled after leaving the oven to a temperature of 200 to 250° C.

Heated-treated iron ore pellets are then removed from the oven to undergo the alcohol by-product spraying stage. In this stage, a proportion of 500 g of alcohol by-product per ton of fired pellets must be observed, a value that can be optimized depending on the amount of fines aggregated on the surface of the pellet. The preferred alcohol by-product is glycerin from biofuel, for example. Other compounds may be used provided they have the same physical-chemical properties.

After the still-hot pellets have been sprayed with glycerin, they are ready to be handled or transported without the emission of iron ore particles. It's at this final stage that a particulate emission control is made.

This process, the object of the present invention, is preferably used on pellets coming from iron ore pelletizing processes; however, it can be applied in conjunction with other unit operations in other mining processes where there is emission of particulates.

The main function of this process is to prevent the emission of iron ore particulates derived from the friction between heat-treated or fired pellets. This friction occurs mainly when the pellets are being handled, stacked, loaded, and unloaded.

Moreover, the present invention addresses the use of an alcohol by-product to inhibit particulate emissions.

This alcohol by-product must be sprayed on the heat-treated iron ore pellets resulting from the iron ore pelletizing processes.

The preferred alcohol by-product is glycerin (glycerol+propanotriol), derived from biofuel. However, other compounds may be used, provided they have the same physical-chemical properties and actions on the product.

Particulate emission inhibiting actions on the product (heat-treated iron ore pellets):

- The inhibitor must have the property of spreading either naturally or by capillary effect after being applied to fired pellets, between the constituent parts of the mass, such as pellets deposited in stockyards, thereby automatically and significantly improving the degree of coverage on the mass as a whole;
- The inhibitor must have sufficient hygroscopicity as a mechanism to maintain a minimum level of moisture in the pellet mass, helping to retain dust or particulates on its surface.
- In the case of the iron ore pellet production process, the inhibitor must prevent the degeneration of the physical and metallurgical qualities of the pellets that result in their degradation due to excess water sprayed on the material to be handled and/or transported;
- In the case of iron ore pellets, the inhibitor must preserve the pellets' physical qualities and significantly reduce the application of water in such a way as to allow greater marginal gains in the process productivity, implying an extra volume of pellets and a reduction in transportation price, owing to the smaller amount of water shipped.
- The inhibitor must partially or completely replace the water during the process involving handling, stacking, loading, and unloading of pellets, granules, fines, and other products originating from iron ore and other minerals, in order to dramatically reduce the emission of particulates (dust) in the operational area.
- The particulate emission inhibitor must comply with the requirements set forth by environmental agencies.

In the case of the present invention, the use of glycerin as a particulate emission inhibitor complies with all of the above listed specifications and actions.

Laboratory Tumbling Test to Verify the Efficacy of the Application of Glycerin on Heat-Treated Iron Ore Pellets:

Laboratory tumbling tests were conducted to verify the efficacy of applying glycerin on pellets at 200° C. for the purpose of inhibiting the emission of particulates generated by the effect of friction or abrasion, simulating pellets handling process during transfer, stacking, recovery, loading, and unloading.

The test consisted of spraying glycerin on 10 kilos of heated pellets collected as they exited the oven. Immediately after spraying, the pellets were submitted to tumbling using the abrasion drum (ISO3271-1995) for 1 minute. After tumbling, the drum door was immediately opened and the emission of particulates in suspension inside the drum was measured with specific measuring equipment, the result of which is expressed in $mg/m^3$. The sequence of tasks in the course of the test was standardized to minimize possible loss of time and, consequently, pellet heat loss during the test.

Laboratory tests results showed a reduction in particulate emission in order of 500 $mg/m^3$ to 100 $mg/m^3$ after the application of glycerin. These results were obtained with the preferred dosage of 500 grams of glycerin per ton of heat-treated or fired pellets. However, other dosages can be used to obtain a satisfactory reduction in particle emission.

Thus, it was confirmed that glycerin is an inhibiting product of particulate emissions when applied to iron ore pellets. The results also showed that glycerin can be applied on an industrial scale to inhibit particulate emissions when pellets are being handled in the course of stacking, loading, and unloading.

Obtaining this glycerin is also advantageous given that, for every 10 liters of biofuel produced, one liter of glycerin is produced in the processing unit.

Figure 2:
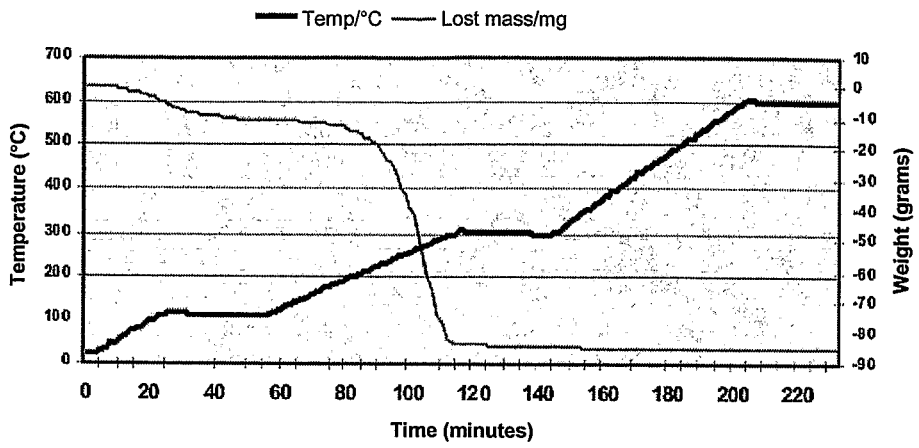
FIG. 2—presents a graph indicating the thermogravimetry of the glycerin used in the test.

While underscoring the advantages of using glycerin as a particle emission inhibitor during friction between still-hot iron ore pellets, the graph in FIG. 2 illustrates the thermogravimetry test of the glycerin used in the aforementioned test, showing its resistance when subjected to high temperatures, thereby making it suitable for the desired application on still-hot pellets (boiling at 290° C.).

It is important to emphasize that glycerin may also be used on other materials with properties similar to those of particulate-emitting iron ore and pellets.

Having described a preferred embodiment example, it shall be understood that the scope of the present invention covers other possible variations, being limited only by the content of the attached claims, including possible equivalents.

The invention claimed is:

1. A process of inhibiting particulate emission caused by friction of heat-treated iron ore pellets consisting of:

- providing iron ore pellets in an oven;
- subjecting the iron ore pellets to a heat treatment in an oven at a temperature above 250° C. and below 1350° C.;
- removing the heat-treated iron ore pellets from the oven and cooling to a temperature between 200° C. and 250° C.; and
- spraying glycerin on the heat-treated iron ore pellets immediately after the cooling, wherein the glycerin is a particulate emission inhibitor that does not evaporate when in contact with the heat-treated iron ore pellets,
- wherein particulate emission of the heat treated iron ore pellets is reduced from about 500 $mg/m^3$ prior to spraying glycerin to about 100 $mg/m^3$ after spraying glycerin, wherein the particulate emission is measured under the following conditions: the heat treated iron ore pellets with and without spraying glycerin are separately submitted to tumbling using an abrasion drum under International Standard: ISO3271:1995 for 1 minute, the drum door is immediately opened and an emission of particulate in suspension inside the drum is measured.

2. The process of claim 1, wherein the glycerin is in a proportion of 500g per ton of the heat-treated iron ore pellets.

3. The process of claim 1, wherein the friction of the heat treated iron ore pellets occurs during stacking, loading, or unloading of the iron ore pellets.

4. The process of claim 1, wherein the glycerin is derived from biodiesel production.

5. A process of inhibiting particulate emission caused by friction of heat-treated iron ore pellets comprising:

providing iron ore pellets in an oven;

subjecting the iron ore pellets to a heat treatment in an oven at a temperature above 250° C. and below 1350° C.;

removing the heat-treated iron ore pellets from the oven and cooling to a temperature between 200° C. and 250° C.; and spraying glycerin on the heat-treated iron ore pellets immediately after the cooling, wherein the glycerin is a particulate emission inhibitor that does not evaporate when in contact with the heat-treated iron ore pellets, wherein particulate emission of the heat treated iron ore pellets is reduced from about 500 $mg/m^3$ prior to spraying glycerin to about 100 $mg/m^3$ after spraying glycerin, wherein the particulate emission is measured under the following conditions: the heat treated iron ore pellets with and without spraying glycerin are separately submitted to tumbling using an abrasion drum under International Standard: ISO3271:1995 for 1 minute, the drum door is immediately opened and an emission of particulate in suspension inside the drum is measured.

6. The process of claim 5, wherein the glycerin is in a proportion of 500g per ton of the heat-treated iron ore pellets.

7. The process of claim 5, wherein the glycerin is derived from biodiesel production.

8. The process of claim 5, wherein the friction of the heat treated iron ore pellets occurs during stacking, loading, or unloading of the iron ore pellets.

9. A process of inhibiting particulate emission caused by friction of heat-treated iron ore pellets comprising:

providing iron ore pellets in an oven;

subjecting the iron ore pellets to a heat treatment in an oven at a temperature above 250° C. and below 1350° C.;

removing the heat-treated faw iron ore pellets from the oven and cooling to a temperature between 200° C. and 250° C.; and spraying glycerin on the heat-treated iron ore pellets immediately after the cooling, wherein the glycerin is in a proportion of 500g per ton of the heat-treated iron ore pellets, and wherein the glycerin is a particulate emission inhibitor that does not evaporate when in contact with the heat-treated iron ore pellets, wherein particulate emission of the heat treated iron ore pellets is reduced from about 500 $mg/m^3$ prior to spraying glycerin to about 100 $mg/m^3$ after spraying glycerin, wherein the particulate emission is measured under the following conditions: the heat treated iron ore pellets with and without spraying glycerin are separately submitted to tumbling using an abrasion drum under International Standard: ISO3271:1995 for 1 minute, the drum door is immediately opened and an emission of particulate in suspension inside the drum is measured.

* * * * *